United States Patent [19]

James et al.

[11] Patent Number: 4,891,928

[45] Date of Patent: Jan. 9, 1990

[54] CARTON LOADING MACHINE

[75] Inventors: Robert C. James; Lloyd Kovacs; Matthew R. Lind, all of Sheboygan, Wis.

[73] Assignee: Hayssen Manufacturing Company, Sheboygan, Wis.

[21] Appl. No.: 244,717

[22] Filed: Sep. 14, 1988

[51] Int. Cl.[4] ..... B65B 43/52

[52] U.S. Cl. ..... 53/250; 198/836; 53/564; 493/319

[58] Field of Search ..... 53/564, 566, 250, 252, 53/253, 251, 458, 457; 198/836; 493/319, 318; 141/114

[56] References Cited

U.S. PATENT DOCUMENTS

| | | | |
|---|---|---|---|
| 1,275,759 | 8/1918 | Russell | 493/319 |
| 1,873,059 | 8/1932 | Smith et al. | 53/73 |
| 3,378,128 | 4/1968 | Stevenson, Jr. et al. | 493/319 X |
| 3,517,477 | 6/1970 | Thornton | 53/53 |
| 4,642,975 | 2/1987 | Langen et al. | 198/836 X |

FOREIGN PATENT DOCUMENTS 2061219 5/1981 United Kingdom .

*Primary Examiner*—James F. Coan

*Attorney, Agent, or Firm*—Senniger, Powers, Leavitt and Roedel

[57] ABSTRACT

A carton loading machine comprising an endless conveyor carrying a series of holders each adapted to hold an erected carton in upright position and movable to move each holder from a carton receiving station for entry of an erected carton in the holder from the outside of the conveyor to a loading station for loading the carton and thence to a discharage station for discharge of the loaded carton, each holder having a fixed side and a movable side and latch members associated with said sides, the latch member associated with the fixed side and the movable side and latch member associated therewith being movable between open and closed positions.

14 Claims, 7 Drawing Sheets

CARTON LOADING MACHINE

BRIEF SUMMARY OF THE INVENTION

This invention relates to carton loading apparatus, and more particularly to a conveyor for conveying opened cartons to and through a number of stations including a station where each carton is loaded.

The invention is particularly useful as the carton conveyor in the apparatus for forming, filling and sealing bags and depositing the bags in cartons disclosed and claimed in the copending coassigned U.S. patent application of Lloyd Kovacs Ser. No. 065,014, filed June 19, 1987, entitled Forming, Filling and Sealing Bags and Depositing Them in Cartons, said application being incorporated herein by reference. The carton conveyor of that application is an endless conveyor comprising endless chains carrying a series of carton holders (sometimes referred to as "buckets") spaced at equal intervals therealong through an endless generally horizontal and generally square path such as shown in the coassigned Langen et al. U.S. Pat. No. 4,642,975 issued Feb. 17, 1987, but with an improved means for setting up or erecting cartons for delivery to a holder at a carton delivery station, this U.S. Pat. No. 4,642,975 also being incorporated herein by reference.

The carton holders or "buckets" of the carton conveyor of said U.S. application Ser. No. 065,014 and said U.S. Pat. No. 4,642,975 are generally of fixed U-shape in horizontal cross section, having what amounts to a back wall and fixed side walls extending forward (outward) from the back wall spaced a distance corresponding to the width of an opened carton, the holder being open at its outside or front (relative to the conveyor) for insertion into the holder at the carton delivery station of an erected open carton from the outside of the conveyor, and removal of the filled and closed carton from the holder at the carton discharge station. With the holders or buckets having fixed side walls as disclosed in said U.S. application Ser. No. 065,014 and said U.S. Pat. No. 4,642,475, it has been found that erected cartons may not always be firmly held in the holder or bucket, and this at times results in the top and bottom major and minor flaps of the cartons not being folded square, and the carton accordingly being imperfectly sealed and unsightly. This is in consequence of the virtual impossibility of manufacturing cartons without variation in width and depth dimensions and variation in squareness of the cartons when erected. Cartons are die cut and creased using a number of dies depending on the size of the sheet which is cut into carton blanks. From one sheet to another there are differences from one die to another, and the differences increase as the dies wear. After the blanks have been die cut and creased, they are put through a high speed folder and gluer (which may operate at speeds up to 1500 per minute) wherein glue is applied to one edge of each blank and the blank is folded and held under compression until the glue sets, the carton as delivered by the folder and gluer having front and back (major) walls and side (minor) walls and closure flaps at the upper and lower ends of said walls and being in a folded-flat collapsed condition and capable of being set up or erected to an expanded open condition wherein it is substantially rectangular in transverse cross section. Depending on how the score lines at the junctures of the front and back walls break, the set-up of the folder and gluer and other considerations, the amount of overlap of the glued section can vary and the squareness of the glued section can vary. This results in the cartons as set up or erected having a varying face width and at times a slightly out of parallel condition in the height dimension. With the carton glued out of parallel, and not held firmly and square in a holder or bucket, the major and minor flaps may not break square.

Thus, as regards the carton loading apparatus of said U.S. application Ser. No. 065,014 and U.S. Pat. No. 4,642,975, variations in the width (width of the front and back or "major" walls) of cartons and/or variations in the depth (width of the side or "minor" walls) in a run of cartons may at times cause problems in production of nicely squared-up cartons with squared-up major and minor flaps. Also, as regards the carton loading apparatus of said U.S. application Ser. No. 065,014 and U.S. Pat. No. 4,642,975, it is to be observed that a rail or bar (indicated generally at 28 therein) is provided surrounding the conveyor for retaining cartons in the holders or buckets, and that this rail is adjustable in and out relative to the conveyor to accommodate cartons of different depth.

Reference may be made to the published United Kingdom Patent Application No. 2,061,219 showing a carton loading conveyor having holders or buckets each having side walls both of which are pivoted. This will be further discussed following the description of this invention.

Among the several objects of this invention may be noted the provision of carton loading apparatus of the general type specified above with an improved carton holder or bucket system adapted to accommodate variations in dimensions and squareness such as may be encountered in cartons in a given run of cartons for production of squared-up cartons having the top and bottom flaps in alignment; the provision of such apparatus adapted to accommodate cartons of different depth without any equipment for an adjustable external rail for retaining cartons in the holders or buckets; the provision of such apparatus retaining the capability of changing the holders or buckets for accommodating cartons of different widths, depths and lengths; and the provision of such apparatus operable reliably at desired production speeds.

In general, carton loading apparatus of this invention comprises an endless carton conveyor carrying a series of holders each adapted to hold an erected carton in upright position and movable to move each holder from a carton receiving station for entry of an erected carton in the holder from the outside of the conveyor to a loading station for loading the carton and thence to a discharge station for discharge of the loaded carton. Each holder is open at the outside thereof for entry of an erected carton in the holder at the carton receiving station from the outside of the conveyor and has carton-retaining means at the sides thereof movable relative to the holder between an open position for entry of an erected carton in the holder at the carton receiving station and discharge of a loaded carton at the discharge station. Means is provided for effecting opening of the carton-retaining means of each holder for entry of a carton in the holder at the carton receiving station and discharge of a loaded carton at the discharge station and closing of the carton-retaining means to retain a carton in the holder as it progresses from the carton receiving station to the carton loading station and thence to the discharge station. Each holder is removably mounted on the conveyor and has a back and sides extending outwardly from the conveyor. One of the sides is fixed relative to the back. The carton-retaining means comprises a first latch member associated with said fixed side movable relative to said fixed side between a retracted open position with respect to said fixed side for entry of a carton in and discharge of a carton from the holder, and a closed position for retaining a carton in the holder, and a second latch member associated with the other side.

Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 1:
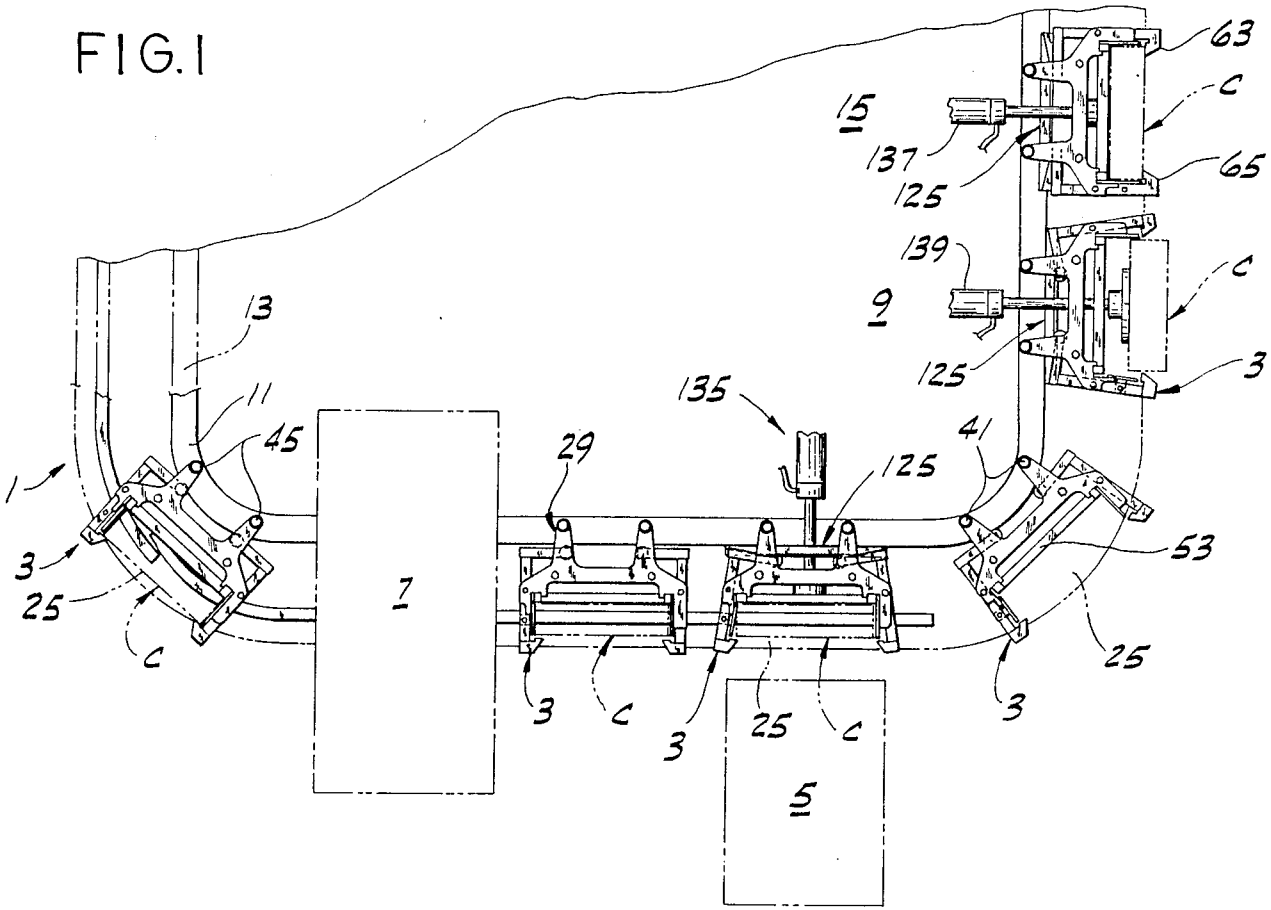
FIG. 1 is a view in plan with parts broken away of carton loading apparatus of this invention, showing the conveyor of the apparatus carrying the carton holders of the apparatus, showing the carton holders at the carton receiving station and at a loaded carton discharge station with the carton-retaining means thereof open, and the carton-retaining means of other carton holders closed.

Referring first to FIG. 1 of the drawings, carton loading apparatus of this invention is shown to comprise an endless carton conveyor generally designated 1 and a series of carton holders each generally designated 3 carried by the conveyor, each adapted to hold an erected carton C in upright position. The conveyor 1 is intermittently movable in an endless horizontal path intermittently to move each holder from a carton receiving station 5 for entry of an erected carton in the holder from the outside of the conveyor to a loading station 7 for loading the carton with the carton content and thence to a discharge station 9 for discharge of the loaded carton. The endless conveyor 1 may be similar to that shown in the aforesaid U.S. Pat. No. 4,642,975 and the aforesaid U.S. patent application Ser. No. 065,014 (incorporated herein by reference), comprising upper and lower endless chains as indicated at 11 and 13 in FIGS. 1 and 5 (corresponding generally to chains 68*a* and 68*b* shown in U.S. Pat. No. 4,642,975) carrying a series of the carton holders 3 spaced at equal intervals therealong through an endless and generally square horizontal path as shown in FIG. 1 of said patent, part of which is shown in FIG. 1 herein. The path has four straight reaches and four rounded corners. The chains are intermittently movable to bring a carton holder 3 from the carton receiving station 5, where a carton is delivered to the holder from a magazine as shown in said patent or preferably as shown in said application Ser. No. 065,014, the carton being opened ("set up") from a flat collapsed configuration for placement in the holder, to the carton loading station 7 where the carton is below a means for loading the carton with the carton content, said means being, for example, the vertical form-fill-seal bag making apparatus such as shown in said U.S. application Ser. No. 065,014, for depositing a filled bag in each carton. From the carton loading station 7, each carton C (with a bag therein, for example) is conveyed through a series of stations as disclosed in said U.S. Pat. No. 4,642,975 and said U.S. application Ser. No. 065,014, the carton being sealed at top and bottom, brought first to a station 15 just ahead of station 9 for ejection if the apparatus may have skipped loading the carton, then to station 9 (assuming the carton has been loaded) for discharge of the loaded carton.

The carton holders 3 are removably mounted on the outside of the chains as will appear, each being adapted to hold an erected carton C in upright position. Each carton has front and back or major walls designated 17 and 19, side or minor walls designated 21 and 23, and major and minor top and bottom closure flaps (not shown herein), corresponding to the cartons shown in said U.S. Pat. No. 4,642,975 and said U.S. application Ser. No. 065,0154.

Each holder is open at the outside thereof (with respect to the conveyor) as indicated at 25 for entry of an erected carton therein at the carton receiving station 5, and has carton-retaining means generally designated 27 at the sides thereof movable relative to the holder between an open position for entry of an erected carton in the holder at the carton receiving station 5 and discharge of a loaded carton at the discharge station 9 (or discharge of an unloaded carton at station 15), and a closed position for retaining the carton in the holder. The conveyor is intermittently operable, as in said U.S. Pat. No. 4,642,975, to index the holders one interval or step on each cycle of operation in such manner that a holder 3 moves into position at the station 5 and dwells there for placement of a carton therein from the outside or front, and another holder moves into position at the carton loading station 7.

Each holder 3 comprises a frame designated in its entirety by the reference numeral 29, this frame comprising an upper member or crosspiece 31, and a lower member or crosspiece 33 and vertical side members 35 and 37, member 35 being referred to as the left side member and member 37 being referred to as the right side member (left and right being as viewed from the open outside 25 of the holder). Each crosspiece has an elongated central body portion 39 extending from adjacent one side of the holder to adjacent the other side, integral arms 41 extending rearwardly from the ends of the body portion 39, and extensions 42 and 43 extending outwardly and forwardly from the left and right ends of the body 39. Each of the arms 41 has a pin 45 extending downwardly adjacent its rearward end, these pins corresponding generally to pins 98 shown in said U.S. Pat. No. 4,642,975, removably receivable in holes 47 in blocks 49 carried by the chains 11 and 13, these blocks corresponding generally to the blocks 100 shown in said patent. The side frame members 35 and 37, shown as constituted by bars of square cross section, are secured at their upper ends and adjacent but above their lower ends in forwardly facing notches 51 in the end extensions 42 and 43 of the upper and lower crosspieces 31 and 33, these side frame members being in a vertical plane forward of the vertical plane of the front edges of the body portions 39 of the crosspieces. A bar 53, shown as of square cross section like the side frame members 35 and 37, extends horizontally between the side frame members 35 and 37 at their lower ends below the level of the lower crosspiece 33.

The vertical side frame bars 35 and 37 and the horizontal bar 53 extending between bars 35 and 37 at their lower ends form a back 55 for the holder engageable by the rear wall of a carton C inserted in the holder, as will appear. The holder has left and right side members 57 and 59 extending forward from the back 55 at the sides thereof. The right side 59 is fixed relative to the back 55 while the left side 57 is movable relative to the back toward and away from the fixed right side 59 and engageable with the left side of an erected carton in the holder to hold it against the fixed right side 59, i.e., to hold the carton with its right side engaging the right side of the holder.

The fixed right side 59 of the carton holder is constituted by a plate secured to the outside of the vertical right side member or back bar 35 and extending forward therefrom at right angles to the plane of the forward face of the back 55, this plate being a relatively long and narrow rectangular plate having a width so related to the width of each side wall of the carton as to extend forward from the front face of the right back bar 35 (and the front face of the lower back bar 53) a distance corresponding generally to the width of the carton side wall, and a length such as to extend the full height of the holder. The plate 59 is secured at its upper end and adjacent its lower end on the inside of forward-reaching portions 61 of the right end extensions 43 of the upper and lower crosspieces 31 and 33, fitting in the right-hand notches 51 in the crosspieces between the bars 35 and said forward-reaching portions 61 of said extensions.

Figure 2:
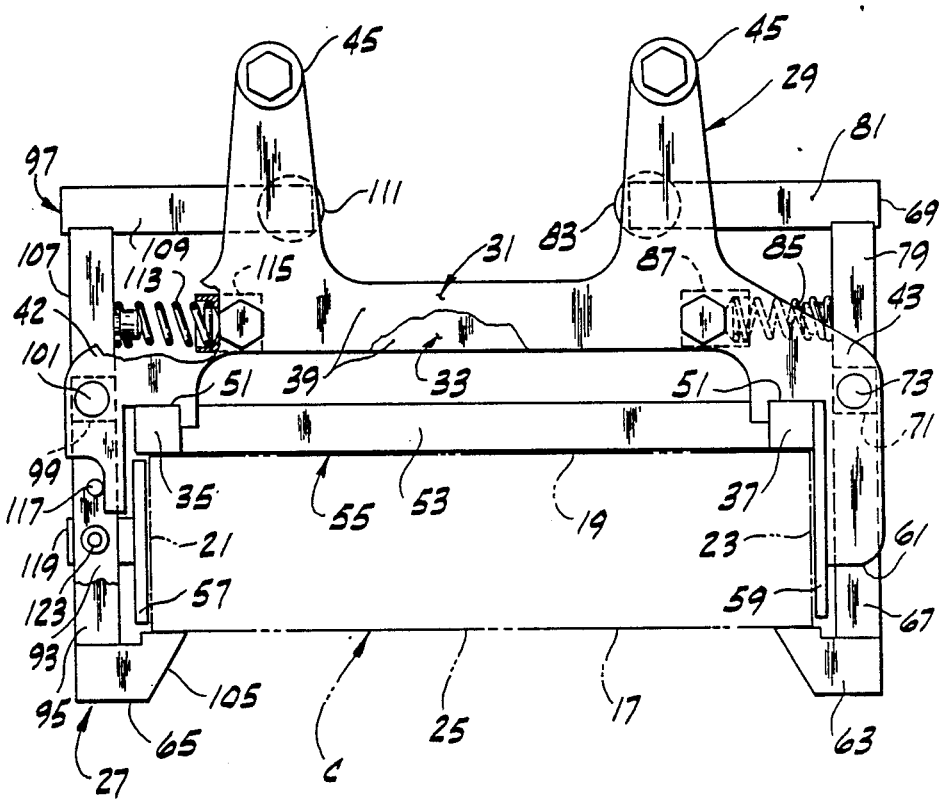
FIG. 2 is an enlarged plan of a carton holder per se showing the carton-retaining means thereof closed, parts being broken away and shown in section.

A carton C is retained in the holder by the carton-retaining means 27, which comprises a first latch member 63 associated with the fixed (right) side of the holder and a second latch member 65 associated with the other side. The first latch member 63 is movable relative to the fixed side of the holder between a retracted open position such as shown in solid lines in FIG. 3 wherein it enables entry of a carton in the holder and discharge of a carton from the holder and the closed position in which it is shown in FIG. 2 and in phantom in FIG. 3 wherein it retains the carton in the holder. The latch member 63, is fastened on the end of an arm 67 of lever means designated in its entirety by the reference numeral 69, this lever means including a vertical shaft 71 pivoted for swinging movement at its upper and lower ends as indicated at 73 and 75 in the extensions 43 of the upper and lower crosspieces 31 and 33. The arm 67 extends forward from the shaft 71 just above the level of the lower crosspiece 33 and the latch member 63 extends laterally from arm 67 at the front of the right side plate 59 of the holder. The latch member 63 is beveled at its inner end forming a cam surface 77 engageable by a carton entering the holder to swing the latch member outwardly. The shaft 71 has an arm 79 extending rearwardly at its upper end. An arm 81 extends inwardly from the rear end of arm 79 and has a roller 83 at its inner end. A coil compression spring 85 acts from a block 87 on the bottom of the upper crosspiece 31 against the arm 79 to bias the shaft 71 to swing in the direction (clockwise as viewed from above) for swinging the latch member 63 to the closed carton-holding position in which it is shown in FIG. 2 and in phantom in FIG. 3 for holding a carton in the holder, this position being determined by engagement of a shim 89 on the inside of the arm 67 with the outside of the fixed side plate 59. The shaft is swingable in the opposite direction by actuation of arm 81 as will appear to swing the latch member 63 to its open position against the closing bias of spring 85.

The movable left side 57 of the holder comprises a relatively long and narrow rectangular plate pivoted as indicated at 91 on upper and lower arms 93 and 95 of lever means designated in its entirety by the reference numeral 97, this lever means including a vertical shaft 99 (similar to 71) pivoted for swinging movement at its upper and lower ends as indicated at 101 and 103 in the extensions 42 at the left of the upper and lower crosspieces 31 and 33. The lower arm 95 is at the same level as arm 67. Latch member 65 extends laterally from arm 95 at the front of the left side plate 57 of the holder, in fixed relation thereto. It is beveled at its inner end forming a cam surface 105 engageable by a carton entering the holder to swing the latch member 63 and plate 57 outwardly. The shaft 99 has an arm 107 extending rearwardly at its upper end. An arm 109 extends inwardly from the rear end of arm 107 and has a roller 111 at its inner end. A coil compression spring 113 acts from a block 115 on the bottom of the upper crosspiece against the arm 107 to bias the shaft 99 to swing in the direction (counterclockwise as viewed from above) for swinging the movable side plate 57 of the holder to the inner carton-holding position in which it is shown in FIG. 2 and in phantom in FIG. 3 wherein it is generally at right angles to the plane of the forward face of the back 55 of the holder at the left side of the holder, this position being determined by engagement of a pin 117 extending down from arm 95 with extension 42 of the lower crosspiece 33. The shaft 99 is swingable in the opposite direction by actuation of arm 109 as will appear to swing the side plate 57 out to the retracted or open position in which it is shown in solid lines in FIG. 3 for entry of an erected carton in the holder and discharge of a carton from the holder. The pivoting at 91 of the side plate 57 to each of the arms 93 and 95 comprises a stud 119 on the outside of the plate in a horizontal slot 121 in the respective arm and a pivot pin 123, the arrangement being such that the plate 57 is pivotally mounted on arms 93 and 95 of the lever means 97 for swinging on a vertical axis generally in a vertical plane at right angles to plate 57 extending centrally of the width of the plate for flatwise engagement with the side of the carton.

Figure 3:
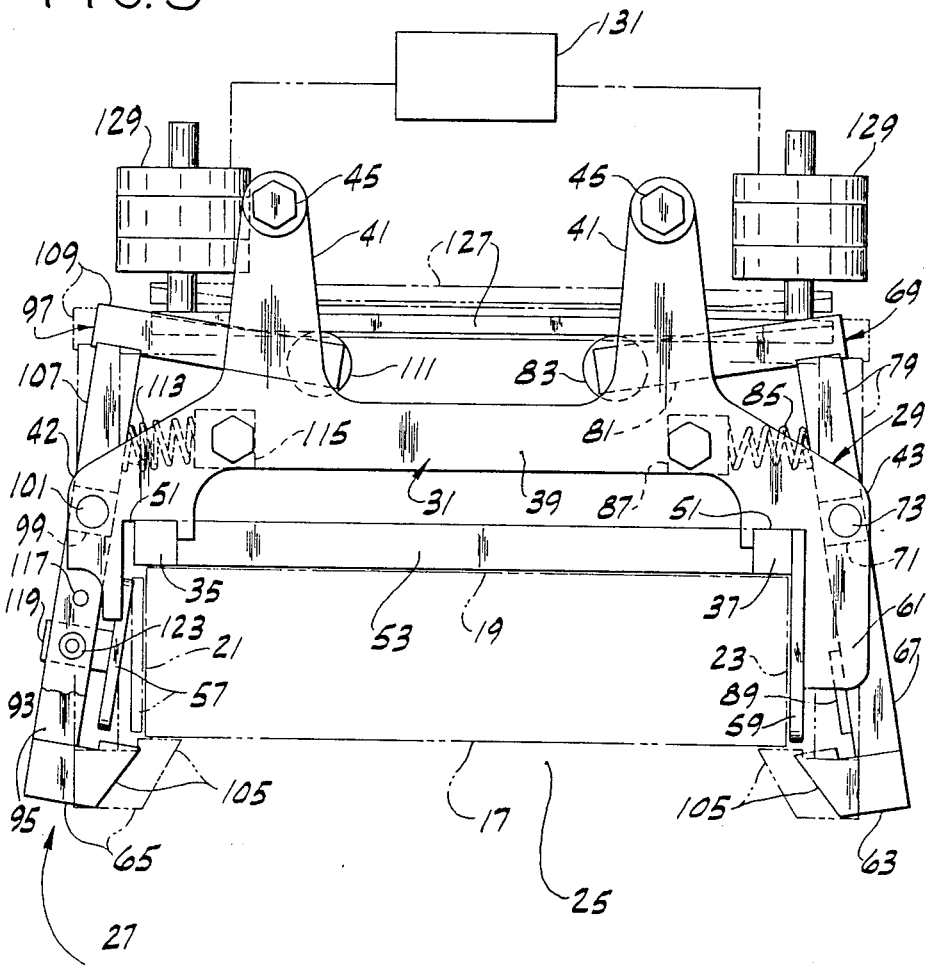
FIG. 3 ia a view similar to FIG. 2 showing a first embodiment of means for effecting opening and closing of the carton-retaining means of a holder, illustrating said means open in solid lines and closed in phantom.
Figure 4:
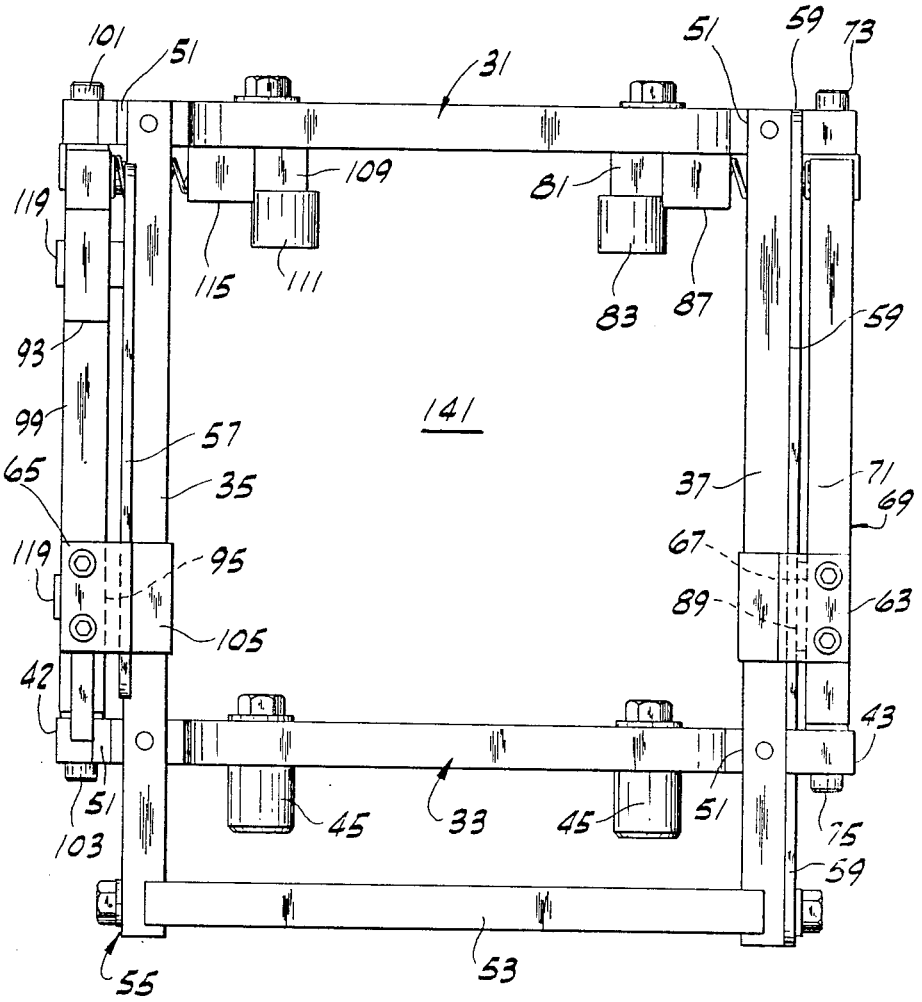
FIG. 4 is a front elevation of FIG. 2.

Referring to FIG. 1, there is generally indicated at 125 at each of stations 5, 9 and 15 means for effecting opening of the carton-retaining means 27 of each carton holder 3, for entry of a carton in the holder at station 5 and discharge of a carton at station 9 or 15 and closing of the carton-retaining means to retain a carton in the holder as it progresses from station 5 to station 7 and thence to stations 15 and 9. Referring to FIG. 3, means 125 at each of stations 5, 9 and 15 is shown to comprise a cam track or rail 127 movable from a retracted position clear of the rollers 83 and 111 of the two lever means 69 and 81 of a holder into a position for engagement by these rollers as the holder reaches a respective station 5, 9, 15 for operating the lever means 69 to swing open the latch member 63 and for operating the lever means 97 to swing open the movable side plate 57 and the associated latch member 65. As the holder 3 enters the station, the rollers ride up an up ramp of the track on to a central dwell section of the track for swinging the two lever means from their retracted to their open position, and as the holder leaves the station the rollers ride off the central section and down a down ramp of the track for releasing the lever means for their closing swing as the holder moves away from the station.

Figure 5:
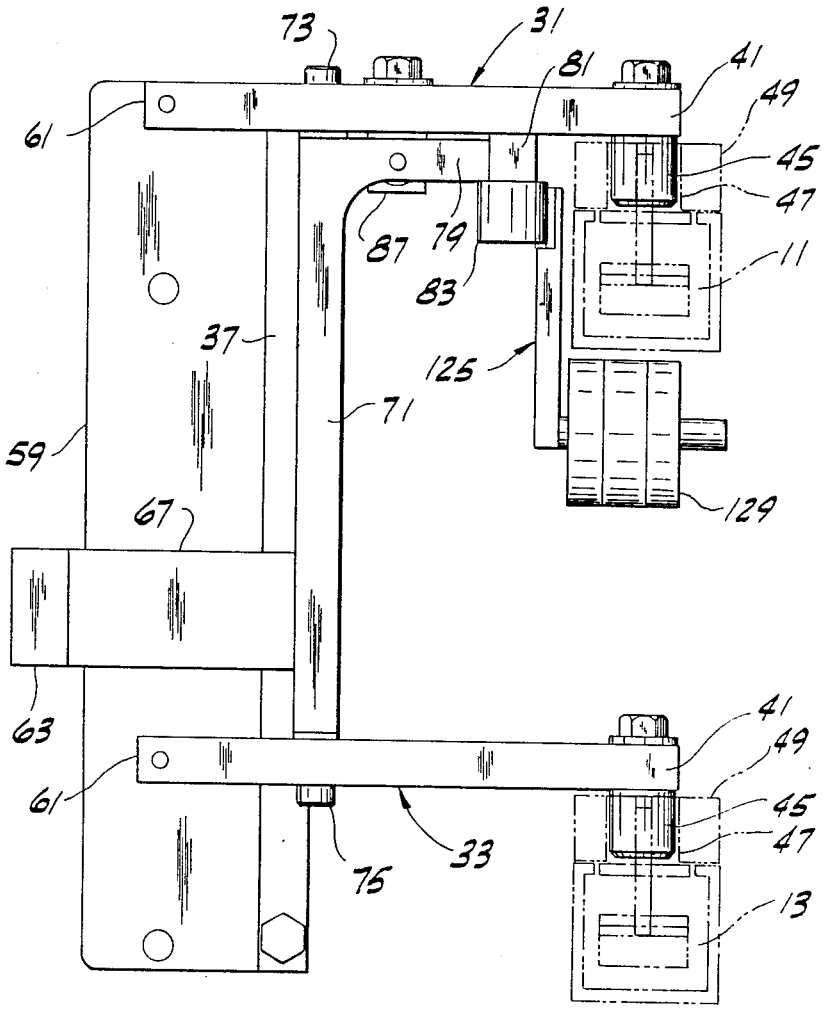
FIG. 5 is a right side elevation of FIG. 3 illustrating in phantom certain conveyor chains which carry the holder and showing the carton-retaining means of the holder closed.
Figure 6:
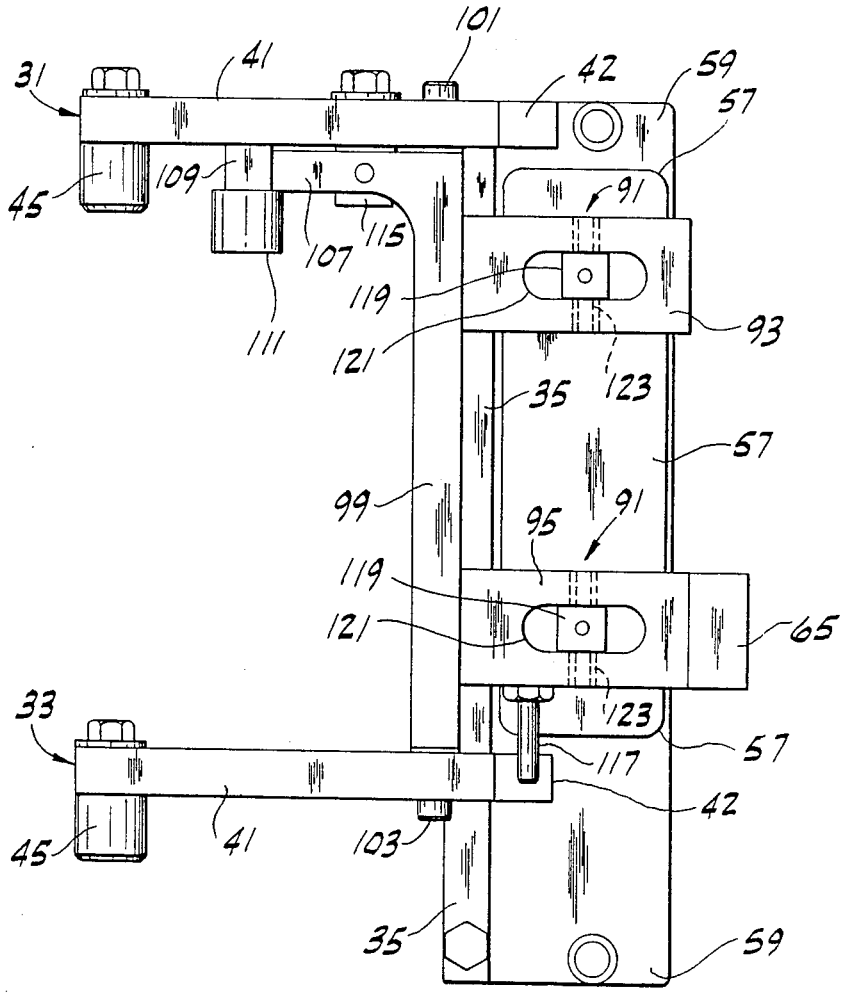
FIG. 6 is a left side elevation of FIG. 2.

Means for moving the track 127 away from and back to its retracted position is shown in FIGS. 3 and 5 to comprise a pair of air cylinders each designated 129, these cylinders being suitably controlled by means indicated generally at 131 for operation on each dwell of the conveyor to move the track to the operative position for effecting the opening swing of the two lever means 69 and 81 of each of the holders at stations 5, 9 and 15, and then ultimately returning the track to a retracted position.

Figure 7:
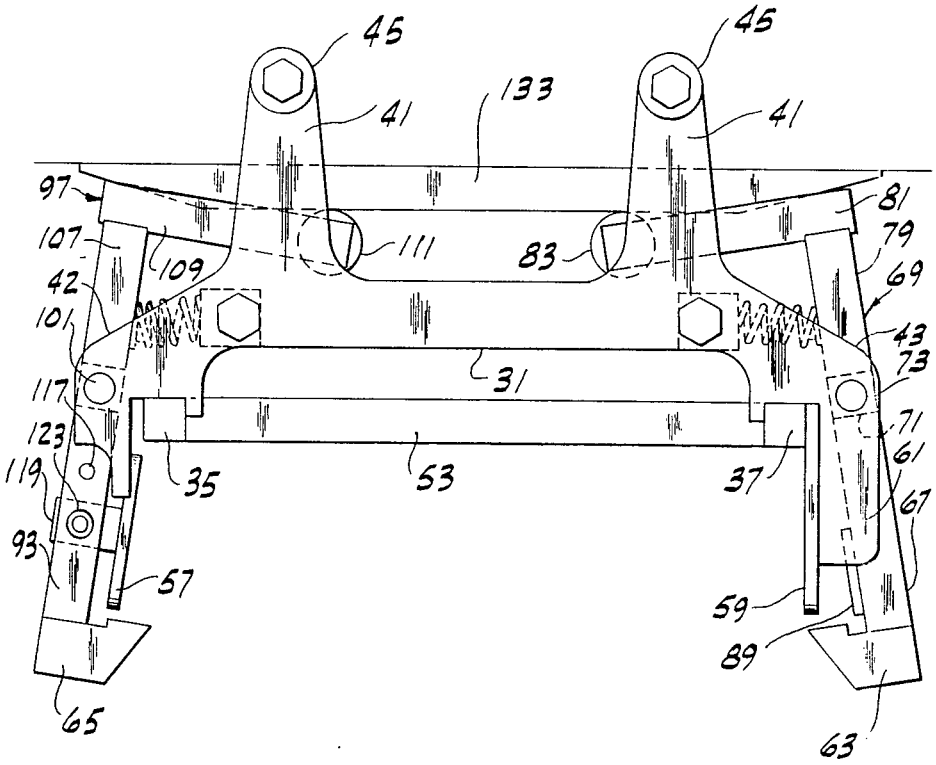
FIG. 7 is a view similar to FIG. 3 showing a second embodiment of the means for effecting opening and closing of the carton-retaining means.

An alternative of the means 125 at each of stations 5 and 9 for the opening of the carton-retaining means 27 of each carton holder 3 for entry of a carton in the holder at station 5 and discharge of a carton at station 9 and for the closing thereof is shown in FIG. 7 to comprise a cam track or cam rail 133 suitably mounted in fixed position at the respective station 5, 9, having the central section and ramps as shown so that as a holder 3 reaches the station, the rollers 111 and 83 ride up on the up ramp to the central section and the two lever means 97 and 69 thereby swing from their retracted to their open position, and as the holder moves away from the station, the rollers ride down the down ramp and release the lever means for their closing swing.

At 135 in FIG. 1 is indicated vacuum gripper means corresponding to that indicated at 103 in the aforesaid U.S. application Ser. No. 065,014 for drawing an opened carton into the opened holder 3 at station 5 and at 137 and 139 are indicated pusher means corresponding to that indicated at 214 and 238 in said U.S. Pat. No. 4,642,975 for ejecting (discharging) a carton C from an opened holder at stations 15 and 9. The vacuum gripper means and pusher means are operable through the opening indicated at 141 in the back 55 of the holder 3 bounded at the sides by bars 35 and 37 and at the bottom by bar 53. Here it may be noted that the back is offset forward of the central portions 39 both of the upper and lower crosspieces 31 and 33, and leaves the top of the back open for bulging out of the back wall of the carton as disclosed in the aforesaid U.S. application.

It will be observed that with the right-hand side plate 59 fixed relative to the back 55 of the holder 3 at right angles to the back of the holder, a fixed position is established for the right-hand side of a carton in the holder at right angles to the back wall of the carton engaging the back 55 (i.e., engaging the forward faces of side bars 35 and 37 and the bottom bar 53 of the back 55) of the holder. The left side plate 57 swings in against the left side wall of the carton, pivotally adjusting itself thereto, and acts to hold the carton with its right side against the right side plate 59, thereby ensuring that the carton as ultimately sealed at top and bottom will be squared up with its top and bottom flaps in alignment, despite variations in dimensions and squareness such as may be encountered in cartons in a given run of cartons. This is to be distinguished from the arrangement shown in the aforesaid United Kingdom patent application No. 2,061,219 where both side walls of each carton holder are pivoted (at 52) and both are biased in the closing direction by springs (not shown). It will be further observed that the holders or buckets 3 are readily changeable for accommodating cartons of different widths, depths and lengths and, with the cartons held in the holders or buckets by the latch members 63 and 65, no adjustable external rail is needed.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Carton loading apparatus comprising an endless carton conveyor, a series of holders carried by the conveyor each adapted to hold an erected carton in upright position, the conveyor being movable to move each holder from a carton receiving station for entry of an erected carton in the holder from the outside of the conveyor to a loading station for loading the carton and thence to a discharge station for discharge of the loaded carton, each holder being open at the outside thereof for entry of an erected carton in the holder at the carton receiving station from the outside of the conveyor, and having carton-retaining means at the sides thereof movable relative to the holder between an open position for entry of an erected carton in the holder at the carton-receiving station and discharge of a loaded carton at the discharge station and a closed position for retaining the carton in the holder, means for effecting opening of the carton-retaining means of each holder for entry of a carton in the holder at the carton receiving station and discharge of a loaded carton at the discharge station and closing of the carton-retaining means to retain a carton in the holder as it progresses from the carton receiving station to the carton loading station and thence to the discharge station, each holder having a back and sides extending outwardly from the conveyor, one of said sides being fixed relative to the back, and said carton-retaining means comprising a first latch member associated with said fixed side movable relative to said fixed side between a retracted open position with respect to said fixed side for entry of a carton in and discharge of a carton from the holder and a closed position with respect to said fixed side for retaining a carton in the holder, and a second latch member associated with the other side.

2. Carton loading apparatus as set forth in claim 1 wherein the said other side is movable relative to the back from a retracted open position, for entry of a carton in and discharge of a carton from the holder, toward said fixed side to a closed position engaging the respective side of the carton in the holder to hold the other side of the carton against said fixed side of the holder.

3. Carton loading apparatus as set forth in claim 2 wherein the second latch member is movable with said movable side of the holder between a retracted open position for the entry of a carton in and discharge of a carton from the holder and a closed position wherein it extends in front of a carton in the holder.

4. Carton loading apparatus as set forth in claim 1 wherein said first latch member is movable laterally with respect to said fixed side, extending laterally in front of a carton in the holder when in its closed position.

5. Carton loading apparatus as set forth in claim 4 wherein said other side of the holder is movable relative to the back toward and away from said fixed side and engageable with the respective side of the carton in the holder to hold the other side of the carton against said fixed side of the holder, said second latch member being movable with said movable side of the holder between a retracted open position for the entry of a carton in and discharge of a carton from the holder and a closed position wherein it extends in front of a carton in the holder.

6. Carton loading apparatus as set forth in claim 5 having means for biasing the first latch member toward its closed position and for biasing said movable side of the holder toward engagement with the said respective side of the carton in the holder and the second latch member toward its said closed position, and wherein the means for effecting opening of the carton-retaining means comprises means at the carton receiving station and means at the discharge station for moving the first latch member to its open position and moving said movable side of the holder and said second latch member to open position.

7. Carton loading apparatus as set forth in claim 6 wherein the first latch member is carried by a first lever means for swinging movement between open and closed position and the said movable side of the holder and the second latch member are carried by a second lever means for swinging movement between open and closed positions, and the means at the carton receiving station and the means at the discharge station each comprises cam means engageable by the lever means.

8. Carton loading apparatus as set forth in claim 7 wherein the cam means is movable between a retracted position clear of the lever means and an operative position wherein it is engageable by the lever means.

9. Carton loading apparatus as set forth in claim 1 wherein said fixed side of the holder comprises a plate fixed at right angles to the back of the holder.

10. Carton loading apparatus as set forth in claim 9 wherein said other side of the holder comprises a plate movable relative to the back from a retracted open position, for entry of a carton in the holder and discharge of a carton from the holder, toward the fixed plate to a closed position engaging the respective side of a carton in the holder to hold the other side of the carton against the fixed plate, the second latch member extending laterally inwardly with respect to the movable plate at the front thereof and being movable with the movable plate.

11. Carton loading apparatus as set forth in claim 10 having spring means biasing the first latch member toward its closed position and spring means biasing the movable plate and second latch member toward closed position, and wherein the means for effecting opening of the carton-retaining means comprises means at the carton receiving station and means at the discharge station for moving the first latch member to its open position and means for moving the movable plate and second latch member to open position against the spring bias.

12. Carton loading apparatus as set forth in claim 11 wherein the first latch member is carried by a first lever means for swinging movement between open and closed position and the movable plate and the second latch member are carried by a second lever means for swinging movement between open and closed positions, and the means at the carton receiving station and the means at the discharge station each comprises cam means engageable by the lever means.

13. Carton loading apparatus as set forth in claim 12 wherein the movable plate is adjustably mounted on said second lever means for flatwise engagement with the respective side of the carton.

14. Carton loading apparatus as set forth in claim 13 wherein the movable plate is pivotally mounted on said second lever means for swinging on a vertical axis generally in a vertical plane at right angles to the movable plate, said plane extending centrally of the width of the movable plate.

* * * * *